US005121731A

United States Patent [19]

Jones

[11] Patent Number: 5,121,731

[45] Date of Patent: Jun. 16, 1992

[54] MEANS FOR MOUNTING A FUEL INJECTOR ON A FUEL RAIL

[75] Inventor: Richard A. Jones, Franklin, Mich.

[73] Assignee: Siemens Automotive L.P., Auburn Hills, Mich.

[21] Appl. No.: 717,960

[22] Filed: Jun. 20, 1991

[51] Int. Cl.[5] ..... F02M 55/02

[52] U.S. Cl. ..... 123/470; 123/468

[58] Field of Search ..... 123/468, 469, 470, 472, 123/456; 239/600, 550

[56] References Cited

U.S. PATENT DOCUMENTS

| | | | |
|---|---|---|---|
| 4,527,745 | 7/1985 | Butterfield et al. | 239/600 |
| 4,562,964 | 1/1986 | Diamond | 239/600 |
| 4,660,774 | 4/1987 | Kwok et al. | 239/600 |
| 4,752,031 | 6/1988 | Merrick | 239/600 |
| 4,844,036 | 7/1989 | Bassler et al. | 123/470 |
| 4,905,651 | 3/1990 | Bonfoglioli et al. | 123/470 |
| 5,012,787 | 5/1991 | Hafner et al. | 123/468 |
| 5,016,594 | 5/1991 | Hafner et al. | 123/470 |

*Primary Examiner*—E. Rollins Cross
*Assistant Examiner*—Thomas N. Moulis
*Attorney, Agent, or Firm*—George L. Boller; Russel C. Wells

[57] ABSTRACT

Bayonet lugs and bayonet slots are provided on a fuel injector and a fuel rail respectively to provide for the injector to be installed in a transverse through-hole in the fuel rail by circumferentially registering the lugs with the slots, inserting the injector into the through-hole to a predetermined depth established by an abutment stop which is sufficient to allow the lugs to pass through the slots, and then twisting the injector about its own axis to remove the lugs from their insertion registry with the slots and cause the injector to become axially captured and correctly indexed in the through-hole.

16 Claims, 1 Drawing Sheet

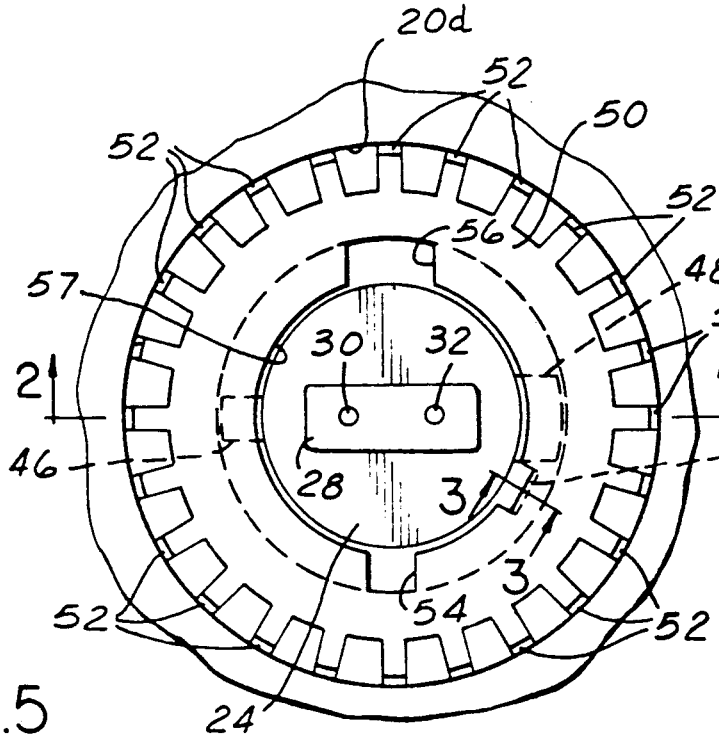
FIG. 1
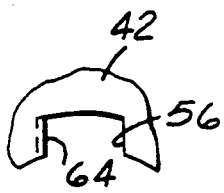
FIG. 6
FIG. 5
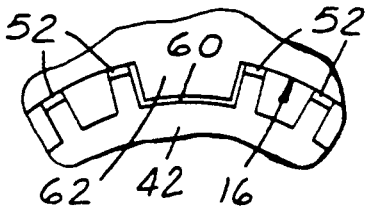
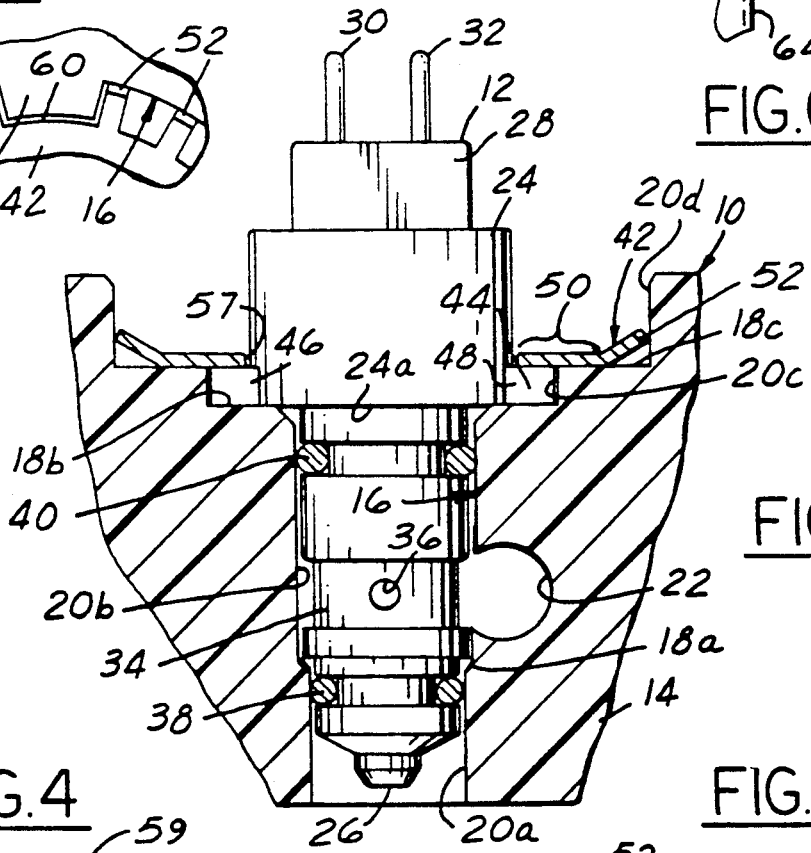
FIG. 2
FIG. 4
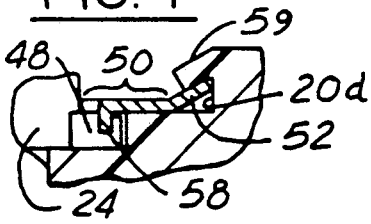
FIG. 3
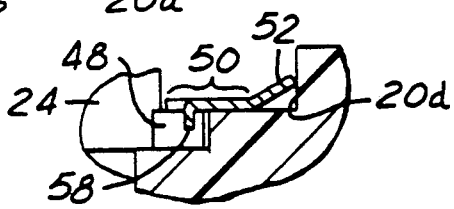

MEANS FOR MOUNTING A FUEL INJECTOR ON A FUEL RAIL

FIELD OF THE INVENTION

This invention relates generally to internal combustion engine fuel systems and more specifically to the mounting of electrically operated fuel injectors on such fuel rails, especially bottom-feed fuel injectors.

BACKGROUND AND SUMMARY OF THE INVENTION

A bottom-feed electrically operated fuel injector is typically characterized by the fact that its fuel inlet is disposed proximal to its fuel outlet and distal to its electrical connector. For example, the fuel inlet may be disposed in the sidewall of the injector body while the fuel outlet is disposed at one axial end of the body and the electrical connector is disposed at the opposite axial end of the body. The typical mounting of such a fuel injector on a fuel rail comprises the fuel injector being disposed in a transverse through-hole in the rail such that: the injector's fuel inlet is in fluid communication with a main longitudinal fuel passage in the fuel rail; the fuel injector's body is sealed to the wall of the transverse through-hole on axially opposite sides of the injector's fuel inlet; the injector's electrical connector is disposed at one axial end of the transverse through-hole so as to be available for connection to a mating electrical connector that delivers operating current to the injector; and the injector's outlet is disposed at the opposite axial end of the through-hole for injecting fuel into the engine for entrainment with combustion air.

It is a typical practice to mount a bottom-feed fuel injector on a fuel rail by inserting the fuel injector, outlet end first, into the transverse through-hole in the fuel rail until the insertion is arrested by abutment with an abutment stop located a predetermined distance inside the through-hole. A cover, which may include an electrical connector for connecting to the electrical connector of the fuel injector, is then disposed over the proximal end of the injector and fastened to the fuel rail to capture the installed injector in the through-hole. Examples of known practices are evidenced by U.S. Pat. Nos. 4,475,486; and 4,844,036. An example of a clip attachment for a top-feed injector is shown by U.S. Pat. No. 4,475,516.

Circumferential orientation of a fuel injector within a transverse through-hole in a fuel rail may also be important. Such is usually the case where the injector is of the split-stream type. It is therefore desirable to provide a circumferential locator for assuring the proper circumferential orientation of a fuel injector in a transverse through-hole in a fuel rail. Examples are evidenced by certain commonly assigned co-pending applications that are known to the USPTO by virtue of their pendency.

The present invention relates to a novel mounting of an electrically operated fuel injector on a fuel rail which may be especially useful for certain engine applications. The invention comprises the inclusion of a keying means associated with one of the through-hole and the injector and a keyed means associated with the other of the through-hole and the injector. The keying means and keyed means are effective to permit the one to pass axially through the other during insertion of the fuel injector into the through-hole, provided that the fuel injector is properly circumferentially oriented to register the keyed means with the keying means, and to permit the fuel injector to be twisted about its own axis after having been fully inserted into the through-hole such that the keying means and the keyed means are removed from registry and are instead placed in an interference relationship preventing the fuel injector from being extracted from the through-hole. An abutment stop is also provided on the one of the keying means and keyed means that is associated with the through-hole for abutment with the fuel injector for the purpose of limiting the extent to which the fuel injector can be twisted once the fuel injector has been fully inserted into the through-hole, thus enabling the fuel injector to be properly circumferentially oriented within the through-hole. The disclosed embodiment of the invention comprises a pair of bayonet lugs on the injector body which constitute the keyed means and an annular disc which is mounted on the fuel rail in the through-hole and embodies a pair of bayonet slots which constitute the keying means.

Further details of the invention, along with advantages and benefits of the invention, will be seen in the ensuing description which is accompanied by drawings. The drawings disclose a preferred embodiment of the invention according to the best mode contemplated at the present time for carrying out the invention.

BRIEF DESCRIPTION OF THE DRAWINGS

FIG. 1 is an axial end view of a fuel injector mounted on a fuel rail in accordance with principles of the present invention.

FIG. 2 is a view, partly in cross section, through FIG. 1 in the direction of arrows 2—2.

FIG. 3 is a fragmentary cross section in the direction of arrows 3—3 in FIG. 1.

FIG. 4 is a fragmentary view in the same sense as FIG. 3, showing a modification.

FIG. 5 is a fragmentary view in the same sense as FIG. 1 showing a modification.

FIG. 6 is a fragmentary view in the same sense as FIG. 1 showing a modification.

DESCRIPTION OF THE PREFERRED EMBODIMENT

FIGS. 2, and 3 show a portion of a fuel rail assembly 10 containing several electrically operated fuel injectors 12 mounted on a fuel rail 14 at intervals along the fuel rail's length. Fuel rail 14 comprises several transverse through-holes 16, and there is one fuel injector 12 disposed in each through-hole 16.

Each through-hole 16 comprises a series of axially outwardly facing circular shoulders separated by radially inwardly facing circular sidewall sections. Thus, in the direction from its inner end to its outer end, each through-hole 16 comprises an inclined shoulder 18*a* between sidewall sections 20*a*, 20*b*, a chamfered shoulder 18*b* between sidewall sections 20*b*, 20*c*, and a shoulder 18*c* between sidewall sections 20*c*, 20*d*. A main longitudinal fuel passage 22 through fuel rail 14 intersects the sidewall section 20*b* of each through-hole 16 in a generally tangential manner.

Fuel injector 12 comprises a body 24 having a generally cylindrical shape. The fuel outlet 26 of the injector is at the axial end of body 24 that is disposed at the inner end of through-hole 16 while the electrical connector 28 of the injector is at the opposite axial end of body 24 and disposed exterior of the outer end of the through-hole. Connector 28 comprises two electrical terminal pins 30, 32 adapted for connection to mating receptacles in a mating connector (not shown) which delivers electric current for operating the fuel injector. The fuel inlet of the injector is provided by a circular groove 34 in the side of body 24 leading to one or more circular holes 36 extending into the interior of the injector.

FIGS. 1-3 illustrate the fuel injector in the fully installed position on the fuel rail. Circular O-ring seals 38, 40 are disposed on body 24 to provide radial sealing between the body and through-hole 16 on axially opposite sides of groove 34 so that fuel which passes into the interior of the injector from fuel passage 22 via groove 34 and hole(s) 36 does not leak out through through-hole 16. The O-ring seals 38, 40 are disposed around the outside of body 24 in respective circular grooves that open radially outwardly.

In accordance with principles of the invention, through-hole 16 is provided with a keying means 42, and injector 12 with a keyed means 44. The keying means 42 is in the form of an annular disc that is disposed in sidewall section **20*d* against shoulder 18*c*. The keyed means 44 comprises a pair of bayonet lugs, or keys, 46, 48 on diametrically opposite sides of that portion of body 24 that is axially co-extensive with sidewall section 20*c***.

A large portion of the disc of keying means 42 is flat and occupies a plane that is perpendicular to the axis of through-hole 16. This portion is designated by the numeral 50. The radially inner margin of portion 50 overhangs sidewall section **20*c*. The radially outer margin of the disc of keying means 42 is canted radially outwardly and axially away from shoulder 18*d*, and comprises a number of circumferentially spaced apart teeth 52. The radially outermost edges of these teeth are digging into sidewall section 20*d* to hold the disc of keying means 42 in assembly with fuel rail 14** in the manner described and illustrated.

The radially inner margin of portion 50 overhanging sidewall section **20*c* comprises diametrically opposite bayonet slots, or keyways, 54, 56, that interrupt the otherwise circular inner edge 57 of the disc of keying means 42, the latter keyway being somewhat larger than the former. Lugs 46, 48 are adapted for respective registry with keyways 54, 56 when the injector is twisted ninety degrees counterclockwise about its own axis from the position illustrated in FIG. 1. The lugs are sized slightly smaller than their respective keyways, so that when registered therewith, they will pass axially through the disc of keying means 42** to allow the injector to be extracted axially out of the through-hole while the disc remains securely in place in assembly with the fuel rail.

The fuel injector is assembled into the fuel rail in the opposite manner from which it was removed. Assembly is accomplished by aligning the injector's axis with the through-hole's axis, circumferentially registering lugs 46, 48 with keyways 54, 56, inserting the injector into the through-hole to pass the lugs through the disc of keying means 42 until the insertion is arrested by the abutment of a shoulder **24*a* of body 24 with shoulder 18*b* of through-hole 16, and then rotating the injector approximately ninety degrees clockwise about its own axis as viewed in FIG. 1 at which point the clockwisemost portion of lug 48 will be abutting a tab 58 extending down from the inner margin of the disc of keying means 42 at approximately the four o'clock position of FIG. 1. The electrical connector (not shown) that delivers operating current to the fuel injector can then be mated with connector 28** of the fuel injector.

From consideration of FIG. 1 it can be appreciated that on account of the particular shape and location of the lugs and keyways, a polarization has been created whereby the fuel injector can be axially seated in the through-hole by initially disposing the fuel injector at only a single unique circumferential orientation relative to the through-hole. FIG. 1 shows that after the lugs have passed through the disc of keying means 42 and the injector has been twisted to move the lugs out of registry with the keyways, the lugs are axially captured between the inner overhanging margin of the disc and shoulder **18*b*. Twisting of the injector until lug 48 abuts tab 58** assures that the injector has been properly circumferentially oriented. Although not specifically shown in the drawings, a detent may be incorporated into the construction so that the attainment of the fully installed position may be tactilely sensed, and as an aid in preventing possible self-loosening of the installed injector.

FIG. 4 illustrates a modification wherein after the disc had been inserted into the through-hole, the rim of sidewall section **20*d* has been deformed (reference numeral 59**) over the outer margin of the disc to axially capture the disc and thus assure that the disc does not shift from its intended position on the fuel rail. Such deformation may occur locally at selected circumferential locations around the rim, or it may be done around the entire circumference.

FIG. 5 illustrates a modification wherein a keying means 60 and a keyed means 62 are provided on the disc and the through-hole to assure proper circumferential orientation of the disc with respect to the fuel rail's through-hole.

FIG. 6 illustrates a modification wherein a tab 64 extends down from the inner margin of the disc to preclude counter-clockwise rotation (as viewed in FIG. 1) of the injector after lugs 46, 48 have been passed through the disc and thereby eliminate the possibility that the injector might be twisted the wrong way.

Typically the fuel rail is fabricated from a suitable composite or relatively soft alloy material. The disc is typically fabricated from relatively harder spring sheet metal, and therefore the radially outermost edges will inherently tend to dig into the composite or relatively soft alloy material. The disc is assembled to the fuel rail by pressing it into the through-hole. The disc's teeth enable it to pass relatively easily into the through-hole but strongly resist removal or rotation once the disc has been pressed into place.

While a presently preferred embodiment of the invention has been illustrated and described, it should be appreciated that principles are applicable to other embodiments that fall within the scope of the following claims. While the illustrated fuel rail is intended to be mounted to an intake manifold of an engine, the fuel rail could be integrated into the manifold, and it is to be understood that use of the term "fuel rail" is intended to include both a separate as well as an integral fuel rail. In its more comprehensive aspects, the invention should be understood to encompass any of a number of various means of joining of the disc to the fuel rail other than those specifically illustrated; for example it is contemplated that with the use of suitable materials, the disc could be made of a composite that is joined to the composite of the fuel rail by conventional composite-joining procedures for the particular composite materials involved.

What is claimed is:

1. An internal combustion engine fuel rail assembly comprising a fuel rail having a main longitudinal passage that is intercepted by transverse through-holes at intervals along the length of the fuel rail, a bottom-feed electrically operated fuel injector disposed in each through-hole by having been inserted, one axial end first, into the through-hole and comprising a fuel inlet that is in fluid communication with said main longitudinal passage so that fuel can pass from said main longitudinal passage to the fuel injector, and mounting means providing for the removable mounting of each fuel injector in the corresponding through-hole characterized in that said mounting means comprises for each injector and the corresponding through-hole an abutment stop within the through-hole that acts on the injector to limit the depth of insertion of the injector into the through-hole, each injector and the corresponding through-hole comprising keying means and keyed means, said keying means being associated with one of each injector and the corresponding through-hole and said keyed means being associated with the other of each injector and the corresponding through-hole, said keying means and said keyed means relating the injector and the through-hole such that the injector can be inserted into the through-hole and into abutment with said abutment stop in a limited number of discrete relative circumferential orientations of the injector and the through-hole, the one of said keying means and said keyed means that is associated with the corresponding through-hole comprising an annulus that cooperates with said abutment stop to axially capture the injector in the through-hole after the fuel injector has been inserted into the through-hole and into abutment with said abutment stop and then twisted about it own axis a certain number of degrees relative to the through-hole, and characterized further in that the annulus is a separate element that is assembled to said fuel rail.

2. An assembly as set forth in claim 1 characterized further in that the separate element is disposed within a portion of the through-hole.

3. An assembly as set forth in claim 2 characterized further in that the separate element is a metallic disc which comprises teeth that bite into a wall surface of the through-hole.

4. An assembly as set forth in claim 3 characterized further in that the teeth are disposed in an outer margin of the metallic disc and are canted away from a shoulder of the through-hole against which a portion of the metallic disc radially inward of the outer margin is disposed.

5. An assembly as set forth in claim 4 characterized further in that the portion of the metallic disc that is radially inward of the outer margin radially inwardly overhangs the shoulder, and the one of said keying means and said keyed means that is associated with the through-hole comprises keyways disposed in that portion of the metallic disc that radially inwardly overhangs the shoulder.

6. An assembly as set forth in claim 1 characterized further in that the keying means comprises slots in the annulus and the keyed means comprises lugs on the injector.

7. An assembly as set forth in claim 6 characterized further in that said keying means and said keyed means are configured to permit passage of one past the other during insertion of the injector into the through-hole for only a single unique circumferential orientation of the injector to the through-hole.

8. An assembly as set forth in claim 6 characterized further by a further abutment stop that is disposed on said annulus to limit the extent to which the injector can be twisted about its own axis after it has been inserted into the through-hole and into abutment with the first abutment stop.

9. An assembly as set forth in claim 6 characterized further in that said further abutment stop is disposed to allow about ninety degrees of twisting of the injector in a particular direction about the injector's axis.

10. An internal combustion engine fuel rail assembly comprising a fuel rail having a main longitudinal passage that is intercepted by transverse holes at intervals along the length of the fuel rail, an electrically operated fuel injector disposed in each such hole by having been inserted, one axial end first, into the hole and comprising a fuel inlet that is in fluid communication with said main longitudinal passage so that fuel can pass from said main longitudinal passage to the fuel injector, and mounting means providing for the removable mounting of each fuel injector in the corresponding hole characterized in that said mounting means comprises for each injector and the corresponding hole an abutment stop that acts on the injector to limit the depth of insertion of the injector into the hole, bayonet lugs on one of each injector and the corresponding hole and bayonet slots in the other of each injector and the corresponding hole, said bayonet lugs and said bayonet slots relating each injector and the corresponding hole such that the injector can be inserted into the corresponding hole and abutted with the corresponding abutment stop in a limited number of discrete relative circumferential registrations of the lugs and slots, and after such insertion and abutment, the injector can be twisted about its own axis to remove said lugs and slots from such insertion registration and become axially captured in the hole, and, in said mounting means for each injector, one of said lugs and said slots is provided in a separate element that is assembled to the fuel rail.

11. An assembly as set forth in claim 10 characterized further in that said lugs and slots are configured for insertion registration in only a single unique circumferential orientation of the injector to the through-hole.

12. An assembly as set forth in claim 11 characterized further in that said lugs are on the injector and said slots are on the fuel rail.

13. An assembly as set forth in claim 10 in which each said hole is a through-hole, and each said fuel injector is a bottom-feed fuel injector and is inserted, outlet end first, into the corresponding through-hole.

14. Means for mounting an electrically operated fuel injector in a hole of a fuel supply member that is supplied with liquid fuel for delivery to the fuel injector comprising an electrically operated fuel injector disposed in such a hole by having been inserted, one axial end first, into the hole and comprising a fuel inlet that receives fuel from the hole, and mounting means providing for the removable mounting of the fuel injector in the hole characterized in that said mounting means comprises an abutment stop on the fuel supply member that acts on the injector to limit the depth of insertion of the injector into the hole, bayonet lugs associated with one of the injector and the hole and bayonet slots associated with the other of the injector and the hole, said bayonet lugs and said bayonet slots relating the injector and the hole such that the injector can be inserted into the hole and into abutment with said abutment stop in a limited number of discrete relative circumferential registrations of the lugs and slots, and after such insertion and abutment, the injector can be twisted about its own axis to remove said lugs and slots from such insertion registration and become axially captured in the hole, wherein one of said lugs and said slots is embodied in a separate element that is assembled to one of said fuel injector and said fuel supply member.

15. Means as set forth in claim 14 characterized further in that said lugs and slots are configured for insertion registration in only a single unique circumferential orientation of the injector to the hole.

16. Means as set forth in claim 15 characterized further in that said lugs are associated with the injector and said slots with the hole.

* * * * *